United States Patent [19]

King

[11] Patent Number: 4,824,167

[45] Date of Patent: Apr. 25, 1989

[54] COMBINATION CHAIR AND LUGGAGE CARRIER

[76] Inventor: Mynor King, 1652 Pacific Ave. #1, San Leandro, Calif. 94577

[21] Appl. No.: 161,843

[22] Filed: Feb. 29, 1988

[51] Int. Cl.[4] ..... A47C 13/00

[52] U.S. Cl. ..... 297/129; 280/30; 297/16; 297/217; 297/130

[58] Field of Search ..... 297/129, 16, 217, 130; 280/30, 47.18

[56] References Cited

U.S. PATENT DOCUMENTS

| | | | |
|---|---|---|---|
| 3,997,213 | 12/1976 | Smith et al. | 297/129 X |
| 4,273,380 | 6/1981 | Silvestri | 297/191 |
| 4,376,547 | 3/1983 | Dominko | 280/30 |
| 4,659,142 | 4/1987 | Kuchinsky | 297/129 |
| 4,703,944 | 11/1987 | Higson | 297/129 |

*Primary Examiner*—James T. McCall
*Attorney, Agent, or Firm*—Bacon & Thomas

[57] ABSTRACT

A combination device disposable in an unfolded position for use wherein it may function as a conventional; or fishing chair, and in a folded position for use as a luggage carrier. The device is defined by a pair of U-shaped metal tubular members which are pivotally connected together, with one member having a pair of legs provided with wheels and angled end portions. The end portions engage the ground in the unfolded position and the wheels engage the ground in the folded position. The other member includes a U-shaped portion which functions as a chair back in the unfolded position and a handle in the folded position. A flexible seat with attached storage pocket, fishing pole support bracket and article support rack are also provided.

6 Claims, 1 Drawing Sheet

FIG. 2
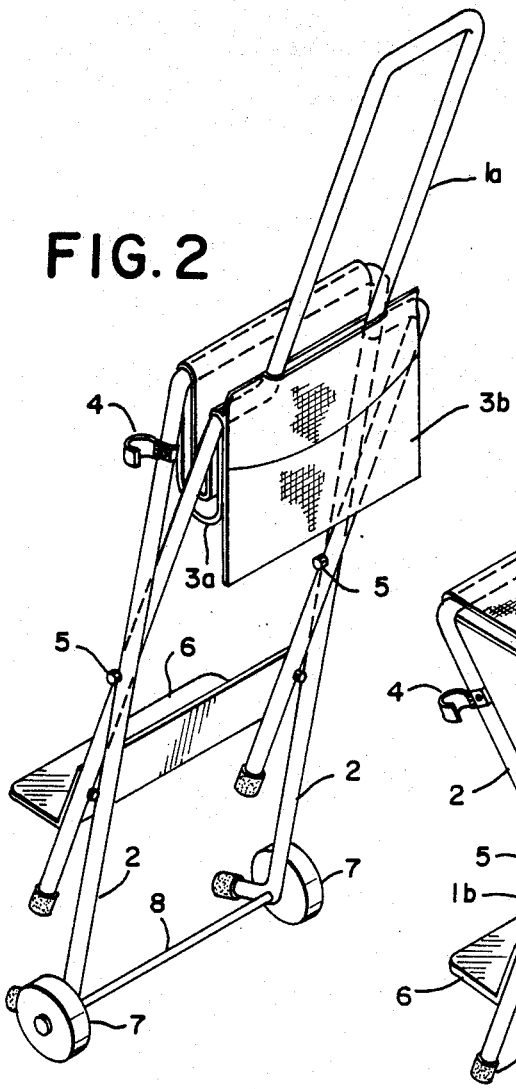
FIG. 1
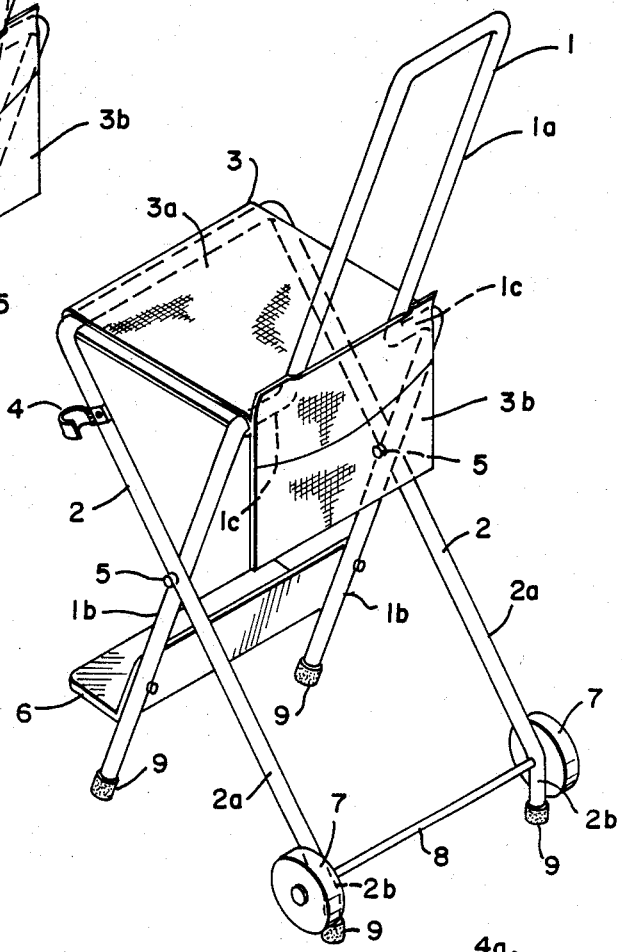
FIG. 3
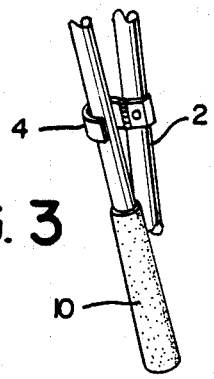
FIG. 6
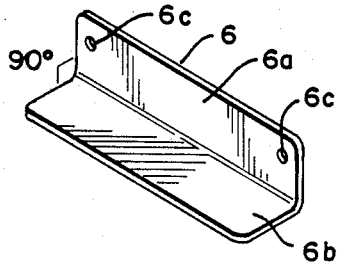
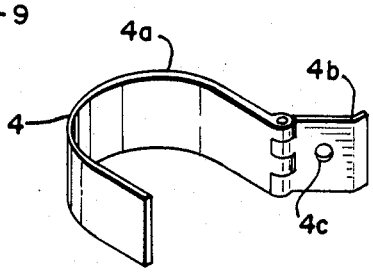
FIG. 5
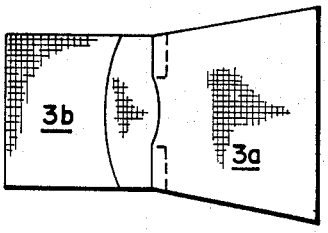
FIG. 4
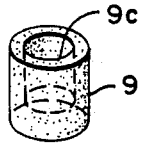
FIG. 7

COMBINATION CHAIR AND LUGGAGE CARRIER

BACKGROUND OF THE INVENTION

1. Field of the Invention

This invention generally involves the field of technology pertaining the chairs which are convertible into luggage carriers.

2. Description of the Prior Art

It is known to provide a chair which is so constructed that it may be folded or collapsed from a position of use into a more compact package for transport or storage. Examples of such chairs are generally disclosed by the Thebaud U.S. Pat. No. 4,186,959, Boudreau U.S. Pat. No. 4,226,467, Day U.S. Pat. No. 4,229,039, Singer U.S. Pat. No. 4,421,357, and Singer U.S. Pat. No. 4,458,270.

SUMMARY OF THE INVENTION

It is an object of the invention to provide an improved chain which may also be folded to form a luggage carrier.

It is another object of the invention to provide a foldable device which is capable of functioning as a conventional chair, a fishing chair and a luggage carrier.

It is a further object of the invention to provide an improved folding chair structure which is simple in construction and easy to operate.

These and other objects of the invention are realized by providing a chair structure which is essentially defined by a pair of substantially U-shaped members that are pivotally secured together to permit the members to be disposed between an unfolded chair position and a folded luggage carrier position. One U-shaped member includes legs provided with a pair of wheels and angled end portions which permit the wheels to be raised off the ground in the unfolded chair position. The other U-shaped member also includes legs provided with a reduced width U-shaped portion which functions as a chair back in the unfolded chair position and a handle in the folded luggage carrier position. A flexible member defining a seat and storage pocket, a fishing pole support bracket and article support rack are also attached to the members. The terminal ends of the legs and end portions are provided with tips to protect the ends from deterioration and debris.

Other objects, features and advantages of the invention shall become apparent from the following detailed description of a preferred embodiment thereof, when taken in conjunction with the drawings wherein like reference characters refer to corresponding parts in the several views.

BRIEF DESCRIPTION OF THE DRAWINGS

FIG. 1 is a perspective view of a combination chair and luggage carrier according to a preferred embodiment of the invention shown in an unfolded position for use as either a conventional chair or a fishing chair.

FIG. 2 is a perspective view of the chair and luggage carrier of FIG. 1 shown in a folded position for use as a luggage carrier.

FIG. 3 is a partial perspective view showing a fishing pole support bracket used for supporting a fishing pole when the chair and luggage carrier is disposed in the unfolded position.

FIG. 4 is a top plan view of a flexible member forming a seat and storage pocket for the chair and luggage carrier.

FIG. 5 is a perspective view of the fishing rod support bracket shown in FIG. 3.

FIG. 6 is a perspective view of a support rack for supporting articles or luggage when the chair and luggage carrier is disposed in both the folded and unfolded positions.

FIG. 7 is a perspective view showing a tip for attachment to each end of the legs and end portions for protecting same against deterioration and debris.

DETAILED DESCRIPTION OF THE EMBODIMENT

A device in the form of a combination chair and luggage carrier according to a preferred embodiment of the invention shall now be described with initial reference to FIG. 1. As shown therein, the device is disposed in an unfolded position so that it may function as either a conventional chair or a fishing chair. The device includes a pair of substantially U-shaped members 1 and 2 which are pivotally connected together by a pair of mechanical fasteners 5, such as bolts. This permits members 1 and 2 to define a pair of spaced X-shaped configurations in the unfolded position. Member 1 includes a pair of spaced legs **1*b*, the terminal ends of which engge the ground. As shown in FIG. 1, the upper portions of legs 1*b* are first angled to define a pair of inwardly directed portions 1*c*, and thereafter extend upwardly to form a U-shaped portion 1*a*, with the legs of portion 1*a* being of a narrower spacing than the spacing between legs 1*b***.

Member 2 includes a pair of spaced legs **2*a* which terminate in a pair of angled end portions 2*b*. A pair of wheels 7 are supported at the opposite ends of an axle 8 connected to legs 2*a* adjacent end portions 2*b*. As is apparent from FIG. 1, the angle between each leg 2*a* and its corresponding end portion 2*b* is such that wheels 7 are supported in a raised position above the ground when the device is disposed in its unfolded position. In the latter position, the terminal ends of legs 1*b* and end portions 2*b* engage the ground, each of which being preferably provided with an appropriate tip 9** for protection against deterioration and debris.

As also shown in FIG. 1, a support bracket 4 is attached to one leg **2*a* of member 2 for supporting a fishing rod when the chair is used as a fishing chair. A flexible web-shaped member 3, including a seat section 3*a* and a pocket section 3*b*, is secured between members 1 and 2. This may be accomplished by looping 3*a* around the upper portion of member 2 and portions 1*c* of member 1, with pocket section 3*b* extending downwardly behind section 3*a*. Attachment of member 3 may be accomplished in any conventional manner deemed appropriate for the practice of the invention as disclosed herein. A support rack 6 is secured to legs 1*b*** and adjacent the ends thereof for supporting articles and luggage.

With reference to FIG. 2, the device is shown in its folded position so that it may function as a luggage carrier. In this position, legs **1*b* and 2*a* are provided about fasteners 5 to bring legs 1*b* and 2*a* together. This permits seat section 3*a* to be folded and disposed inwardly between members 1 and 2. As apparent in FIG. 2, when the folded device is tilted rearwardly, wheels 7 engage the ground so that luggage may be placed on support rack 6 and transported by grasping portion 1*a*** of member 1. It is important to note from FIG. 2 that, because of the aforementioned angle between each leg 2*a* and its corresponding end portion 2*b*, end portions 2*b* are caused to be raised away from their engagement with the ground in order to permit the device to be transported on wheels 7. As also shown in FIG. 2, the terminal ends of legs 1*b* are preferably disposed above wheels 7 in the folded position.

With reference to FIG. 3, there is shown a fishing pole 10 being supported by bracket 4 when the device is in the unfolded position shown in FIG. 1 and used as a fishing chair. A preferred configuration of member 3, which is preferably formed from cloth, is shown in FIG. 4. Pocket section 3*b* may be used for storing books, fishing gear and other such items.

As indicated in FIG. 5, bracket 4 preferably includes an arcuate-shaped portion 4*a* for engagement by fishing rod 10 and a flange portion 4*b* provided with an aperture 4*c* for permitting bracket 4 to be attached to leg 2*a* by an appropriate mechanical fastener. Support rack 6, as shown in FIG. 6, is preferably made of metal and includes a back wall 6*a* and a bottom wall 6*b* which are disposed at a right angle with respect to each other. Back wall 6*a* is also provided with a pair of apertures 6*c* for permitting rack 6 to be attached to legs 1*b* of member 2.

Tip 9, as shown in FIG. 7, is preferably of a cylindrical configuration and provided with a cylindrical recess 9*c* so that recesses 9*c* of tips 9 may receive the corresponding ends of legs 1*b* and 2*a* therein. It is preferable that members 1 and 2 be formed of metal tubing.

It is to be understood that the embodiment of the invention as shown and described herein is to be construed as a preferred example thereof, and that various changes and modifications in size, shape, material and arrangement of parts may be resorted to by one of ordinary skill in the art and within the scope of the appended claims.

I claim:

1. A combination chair and luggage carrier comprising:

(a) first and second substantially U-shaped members defining respective first and second pairs of spaced legs;

(b) means pivotally connecting the members together for disposition between an unfolded position in which the members define a chair, and a folded position in which the members define a luggage carrier;

(c) a flexible web carrier by the first and second members for forming a seat in the unfolded position;

(d) wheel means carried by the first pair of legs;

(e) the first pair of legs terminating in a pair of elongate end portions disposed at an angle with respect to the first legs; and (f) the angle between the first legs and their respective end portions being such that when the members are disposed in the unfolded position, the end portions engage the ground surface and maintain the wheel means in a raised position, and when the members are in the folded position, the wheel means is permitted to engage the ground surface.

2. The chair and luggage carrier of claim 1 wherein the second U-shaped member includes a pair of inwardly directed portions and a U-shaped portion joined to the second legs by the inwardly directed portions, the spacing between the legs of the U-shaped portion being narrower than the spacing between the second pair of legs, whereby the U-shaped portion defines a chair back in the unfolded position and a handle in the folded position.

3. The chair and luggage carrier of claim 2 further including a storage pocket carried by the flexible web.

4. The chair and luggage carrier of claim 1 wherein the first U-shaped member includes bracket means for supporting a fishing rod when the members are in the unfolded position.

5. The chair and luggage carrier of claim 1 wherein the second U-shaped member includes rack means for supporting articles in the unfolded position and luggage in the folded position.

6. The chair and luggage carrier of claim 1 wherein the terminal ends of the second legs and end portions of the firsts legs are each provided with means for protection against deterioration and debris.

* * * * *